United States Patent [19]

Syria

[11] 3,959,640

[45] May 25, 1976

[54] COMPUTER AND DISPLAY SYSTEM FOR SCORING ATHLETIC EVENTS

[76] Inventor: Ronald L. Syria, 4996 Southview, Utica, Mich. 48087

[22] Filed: June 23, 1975

[21] Appl. No.: 589,717

[52] U.S. Cl. ..... 235/151; 235/92 GA; 340/323 R; 116/120; 340/146.2; 235/152

[51] Int. Cl.[2] ..... A63B 71/06; G06F 7/38

[58] Field of Search ..... 235/151, 193, 92 GA, 235/152; 340/323, 146.2; 116/120; 273/1 E; 35/6, 29 R; 445/1

[56] References Cited

UNITED STATES PATENTS

| | | | |
|---|---|---|---|
| 3,470,368 | 9/1969 | Brittan | 235/193 |
| 3,727,213 | 4/1973 | Kurtenbach | 235/92 GA X |
| 3,731,765 | 5/1973 | Robaszkiewicz | 340/146.2 X |
| 3,737,889 | 6/1973 | Sweeny | 235/92 GA X |
| 3,829,664 | 8/1974 | Kashio | 340/146.2 X |

*Primary Examiner*—Edward J. Wise

[57] ABSTRACT

Score inputs are provided from remote locations from a number of judges who individually score the contestants. A central operator at a control console enters for each event the position, degree of difficulty and athlete identification numbers. In accordance with the particular sport being scored, the calculator portion of the system is operable to sum the judges' scores, multiply them by the degree of difficulty, or sum the judges' scores and subtracting high and low scores and then multiplying by the degree of difficulty. A still further programmed arrangement possible with the system is the summation of the judges' scores, subtracting of high and low scores, multiplication by a weighting factor and finally multiplying by a degree of difficulty factor. The system is readily adaptable to a number of different sports having the requirement for a variety of scoring setups, particularly for diving, synchronized swimming, gymnastics and figure skating.

20 Claims, 8 Drawing Figures

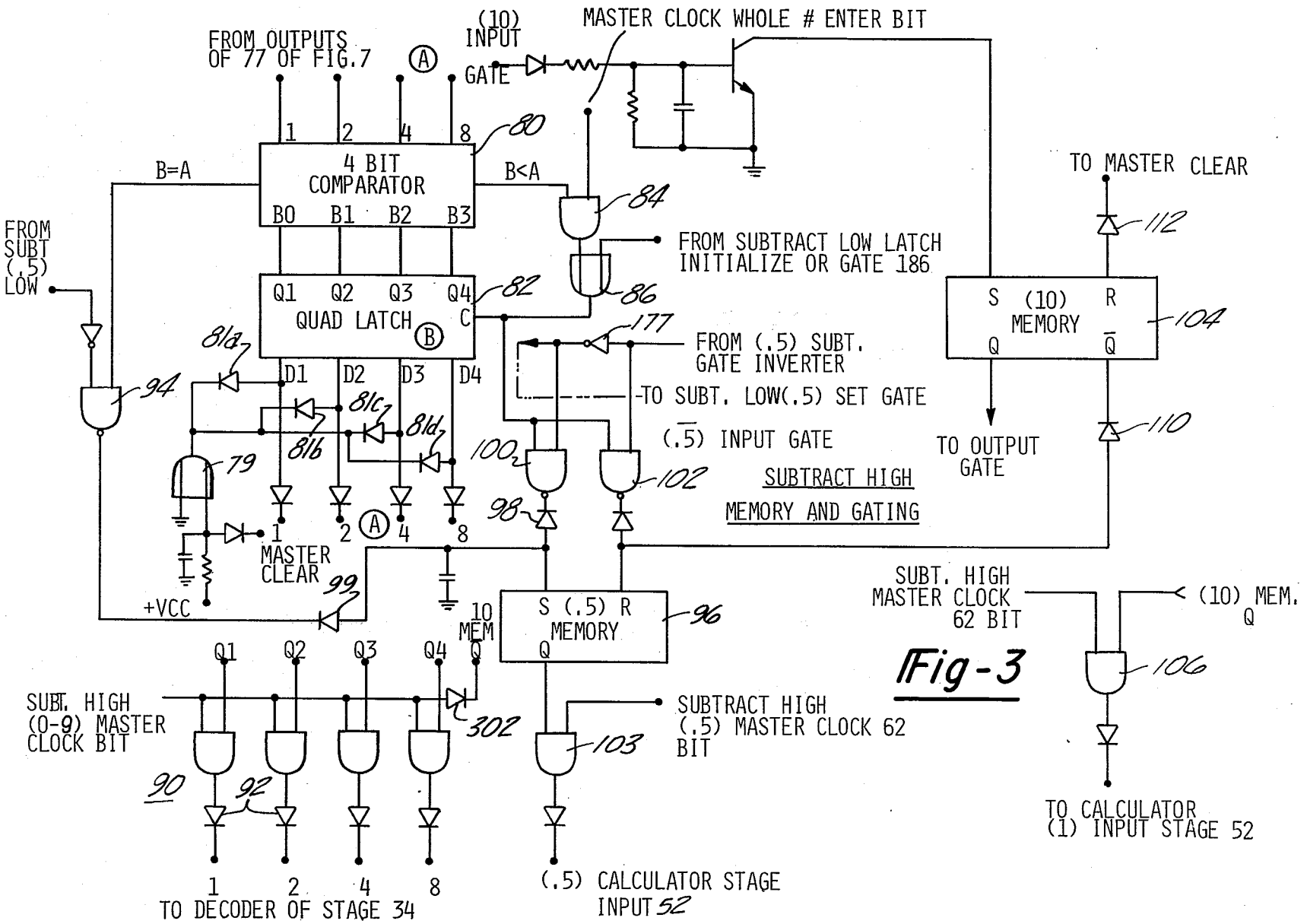
TO MASTER CLEAR
S (10) MEMORY R Q
TO OUTPUT GATE
(10) MEM. Q
TO CALCULATOR (1) INPUT STAGE 52
SUBT. HIGH MASTER CLOCK 62 BIT
Fig-3
MASTER CLOCK WHOLE # ENTER BIT
FROM SUBTRACT LOW LATCH INITIALIZE OR GATE 186
FROM (.5) SUBT. GATE INVERTER
TO SUBT. LOW(.5) SET GATE
(.5) INPUT GATE
SUBTRACT HIGH
MEMORY AND GATING
SUBTRACT HIGH (.5) MASTER CLOCK 62 BIT
S (.5) R MEMORY Q
(.5) CALCULATOR STAGE INPUT 52
(10) INPUT GATE
B<A
4 BIT COMPARATOR
QUAD LATCH
FROM OUTPUTS OF 77 OF FIG.7
B=A
MASTER CLEAR
+VCC
10 MEM Q
TO DECODER OF STAGE 34
FROM SUBT (.5) LOW
SUBT. HIGH (0-9) MASTER CLOCK BIT

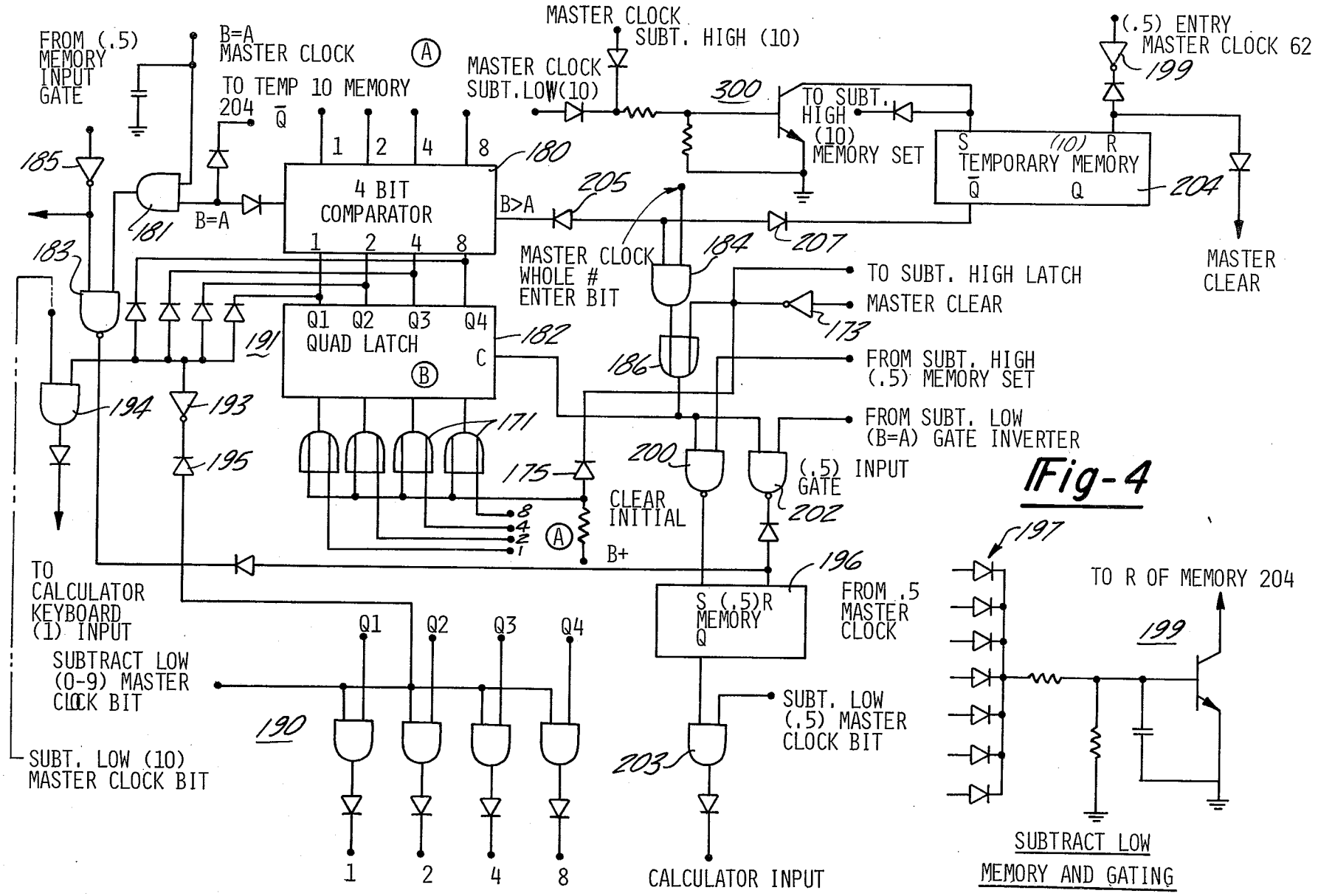
(.5) ENTRY MASTER CLOCK 62
199
MASTER CLEAR
204
(10) TEMPORARY MEMORY
S R Q Q̄
TO SUBT. HIGH (10) MEMORY SET
300
MASTER CLOCK SUBT. HIGH (10)
MASTER CLOCK SUBT. LOW (10)
207
205
TO SUBT. HIGH LATCH
MASTER CLEAR
133
FROM SUBT. HIGH (.5) MEMORY SET
FROM SUBT. LOW (B=A) GATE INVERTER
FROM (B=A) INPUT
184
186
MASTER CLOCK WHOLE # ENTER BIT
180
182
B>A
4 BIT COMPARATOR
QUAD LATCH
Q1 Q2 Q3 Q4
C
171
175
CLEAR INITIAL
B+
(.5) GATE
202
200
FROM .5 MASTER CLOCK
196
S (.5) R MEMORY Q
SUBT. LOW (.5) MASTER CLOCK BIT
203
CALCULATOR INPUT
TO R OF MEMORY 204
199
197
SUBTRACT LOW MEMORY AND GATING
Fig-4
B=A MASTER CLOCK
TO TEMP 10 MEMORY 204 Q̄
181
B=A
FROM (.5) MEMORY INPUT GATE
185
183
191
193
194
195
190
TO CALCULATOR KEYBOARD (1) INPUT
SUBTRACT LOW (0-9) MASTER CLOCK BIT
SUBT. LOW (10) MASTER CLOCK BIT

COMPUTER AND DISPLAY SYSTEM FOR SCORING ATHLETIC EVENTS

BACKGROUND OF THE INVENTION

In scoring athletic events, it is important that the score be registered and computed in the shortest time possible, with the inputs from the several judges, preferably separately channeled, and given at the same time to avoid the score of one judge having an influence on that of the others. The present invention makes this possible with a minimum of time being spent in the actual computation. While the scoring display is shown as being that on a main console, it similarly in accordance with the teachings of the invention may be connected to a larger and more readily visible display board to communicate the score to the spectators at large. A particular feature of importance in scoring certain types of athletic events is that the highest and lowest scores by the group of judges are discarded before the final score is computed. This involves a separate computation step and with conventional calculators or computing equipment adds a considerable delay and, if manually performed, introduces the possibility of human error in the entire process.

The system according to the present invention further makes it possible by the adjunct of a standard printer to arrive at a permanent record for each event, which is automatically arrived at without the intervention of the operator.

BRIEF DESCRIPTION OF THE INVENTION

The present invention thus involves a computerized scoring system which includes in it circuitry capable of high-low selection. By this is meant, discarding of the high and low scores prior to computing the final score. The process whereby this is accomplished includes a comparator and quad latch arrangement in which there is made a comparison from each judge's score being entered to determine whether such score is higher than the highest previous one entered or, alternately, in the low selection portion of the circuit, whether the new judge's score is lower than the lowest score entered previously. This handling of the plurality of input scores and arriving at the total score is through circuitry and through a procedure not known to the prior art and further representative of a substantial advance over what is available.

BRIEF DESCRIPTION OF THE DRAWINGS

Reference is made to the accompanying drawings in which like numerals are used to identify like elements and parts as they may occur in different ones of the drawings, and wherein:

FIG. 3 is a schematic drawing showing a portion of the subtract-high memory and gating stage;

FIG. 4 is a schematic drawing showing of the subtract-low memory and gating stage;

DETAILED DESCRIPTION OF THE PREFERRED EMBODIMENT

Figure 1:
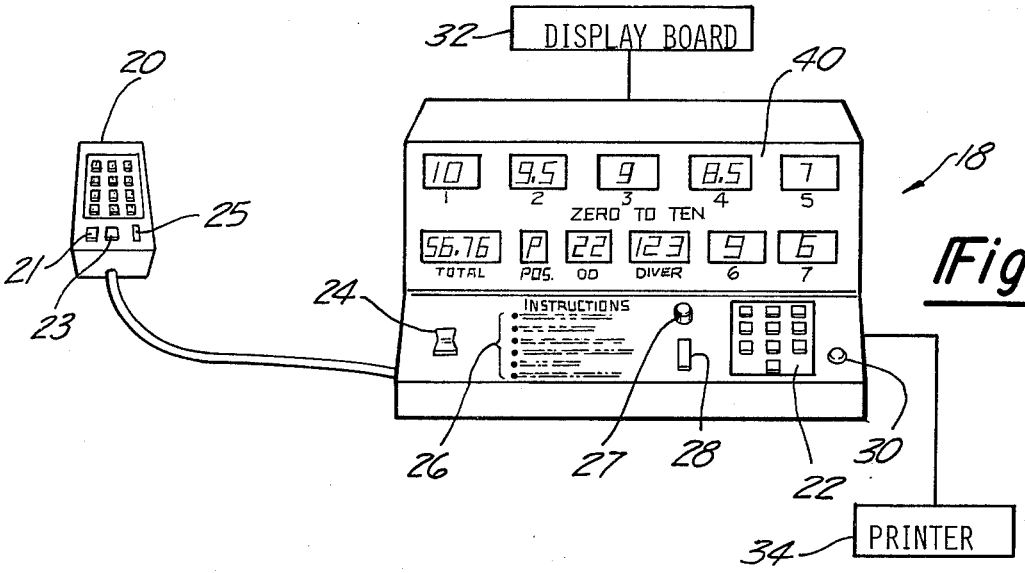
FIG. 1 is a front perspective view of the control console of the system showing input devices and additional optional features in block diagrammatic form.

FIG. 1 shows the console 18 at which an operator is stationed during the athletic events and their judging. The FIG. 1 drawing illustrates a system in which seven judges are involved with a separate viewing window, numbered 1–7, for each respective judge's score. It will be understood that the number of judges and of judge score keyboards 20 may vary depending on the event being scored. Included in each keyboard 20 are a ready button 21, a judge's score LED display 23 and a clear button 25. Each judge further has at his station a score keyboard 20 with a push-button input for 0–10, for 0.5 and a further "clear" button. The console 18 itself further includes a total window and provision for three console operator inputs through the console keyboard 22 which provide the following information for display: dive position (tuck, pike, layout and free), degree of difficulty (DD) and athlete identification number. The operator keyboard 22 further includes a power on-off switch 24, a sequential LED instruction light display 26, a program switch 27, a clear button 28 and a total or compute button 30. As an option, there may be associated with the console 18 a large display board of a size to give the entire group of spectators immediate access to the scores as indicated by the numeral 32. A further provision may be made for print-out from the calculator portion of the system to a printer stage 34, which will be further described hereinafter.

Figure 2:
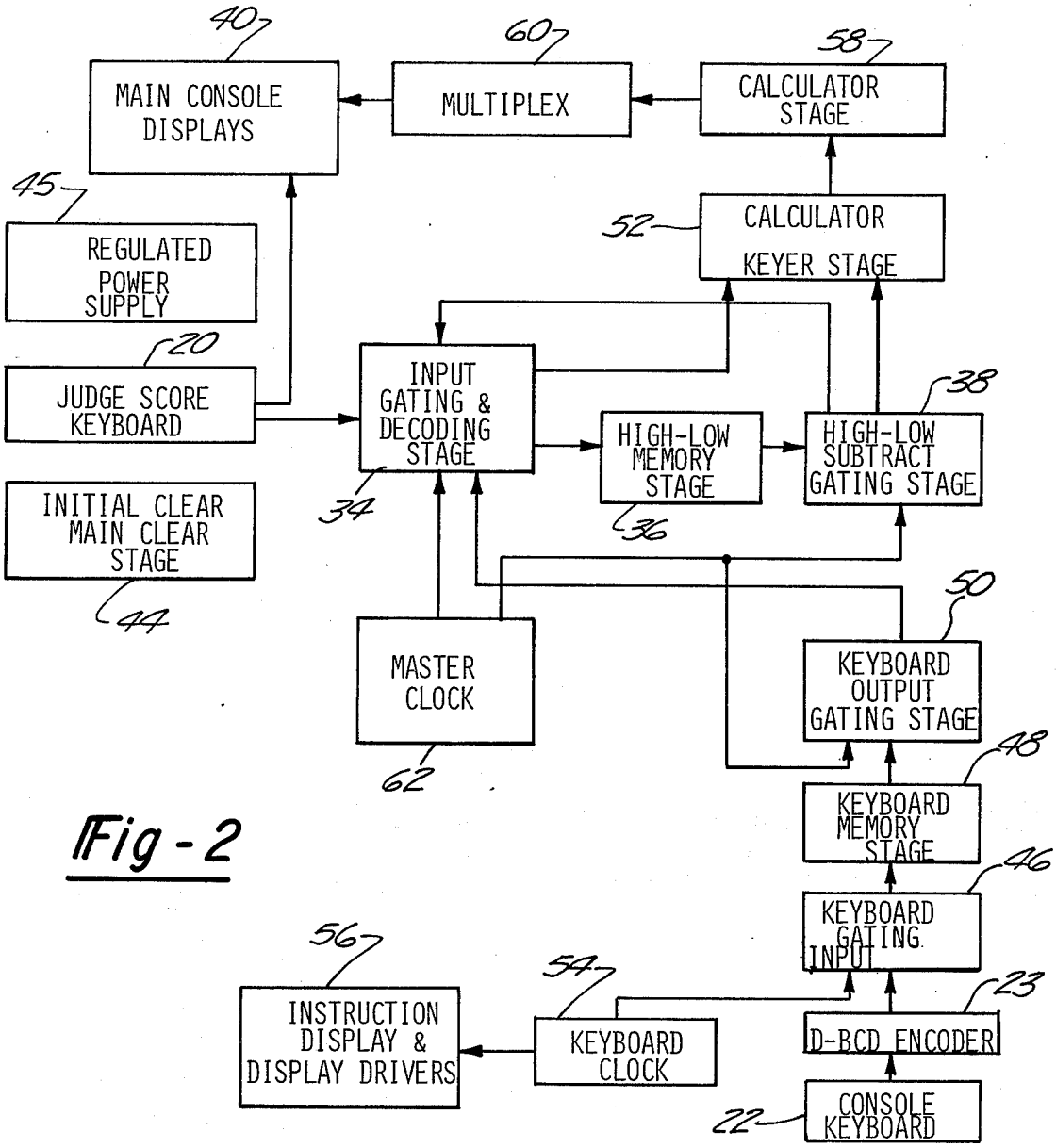
FIG. 2 is a block diagrammatic representation of the different logic elements and input devices of the system.

The main elements of the system are shown in block form in FIG. 2. The judge score keyboard 20, one of seven such units, is used to provide a score input to the input gating and decoding stage 34, the detail of which will be shown and explained in connection with FIG. 7 hereinafter. The output of this stage is communicated to a high-low memory stage 36 and then to a high-low subtract gating stage 38, the detail of which will be shown and explained in connection with FIGS. 3 and 4 hereinafter. A second output is provided from the judge score keyboard 20 directly to the main console display 40 so that the score entered by each judge is identified and passed on to the audience either through announcement by the console operator or by the large display board 32. The system likewise has provision for an "initial clear" and a "main clear" control stage 44 and includes a regulated power supply 45.

At the lower right hand portion of the drawing of FIG. 2, there is included the main console keyboard 22 followed by a decimal to BCD encoder 23 which provides a binary coded decimal input to the next following keyboard gating input stage 46, to the keyboard memory stage 48 and to the keyboard output gating stage 50, which last stage provides an output to the calculator keyer stage 52. The circuitry comprises stages 46, 48, 50 and 52 and will be further shown and explained in conjunction with FIG. 5 hereinafter.

It will further be seen that a keyboard clock 54 is included in the system to control the operation of the keyboard gating input stage 46 and further to initiate the operation of the instruction display and display drivers stage 56. The remainder of the system is shown at the upper portion of the FIG. 2 drawing which includes the calculator stage 58 and multiplex 60, which last stage has its output connected to the main console display 40 to show the finally computed total score which has been calculated, as well as the other data entered into the console keyboard 22.

It will further be seen that a master clock 62 is included in the system to control the timed synchronization of the several stages associated with it; more particularly, the input gating and decoding stage 34, the high-low memory stage 36, the high-low substract gating stage 38 and the keyboard output gating and decoder stage 50. It is the basic function of the master clock 62 thus to take the various outputs of the various stages of the keyboard memory stage 48 and transfer these to the calculator interface exemplified by the calculator or keyer stage 52. Actually, the two-character number that is representative of the degree of difficulty, for example 1.5, 2.2 or the like, is the only data that is passed through the keyboard output gating stage 50 to be finally used in the calculation. The additional keyboard information entered into the console keyboard 22 is merely for the purpose of display and for information of the spectators. There are, of course, other memories in the keyboard 22 entry relative to a three-character athlete number, several digits for the position of the athlete, but that sort of information is not actually transferred into the computer or calculator stage 58 simply because it is not required for the calculation.

Figure 6:
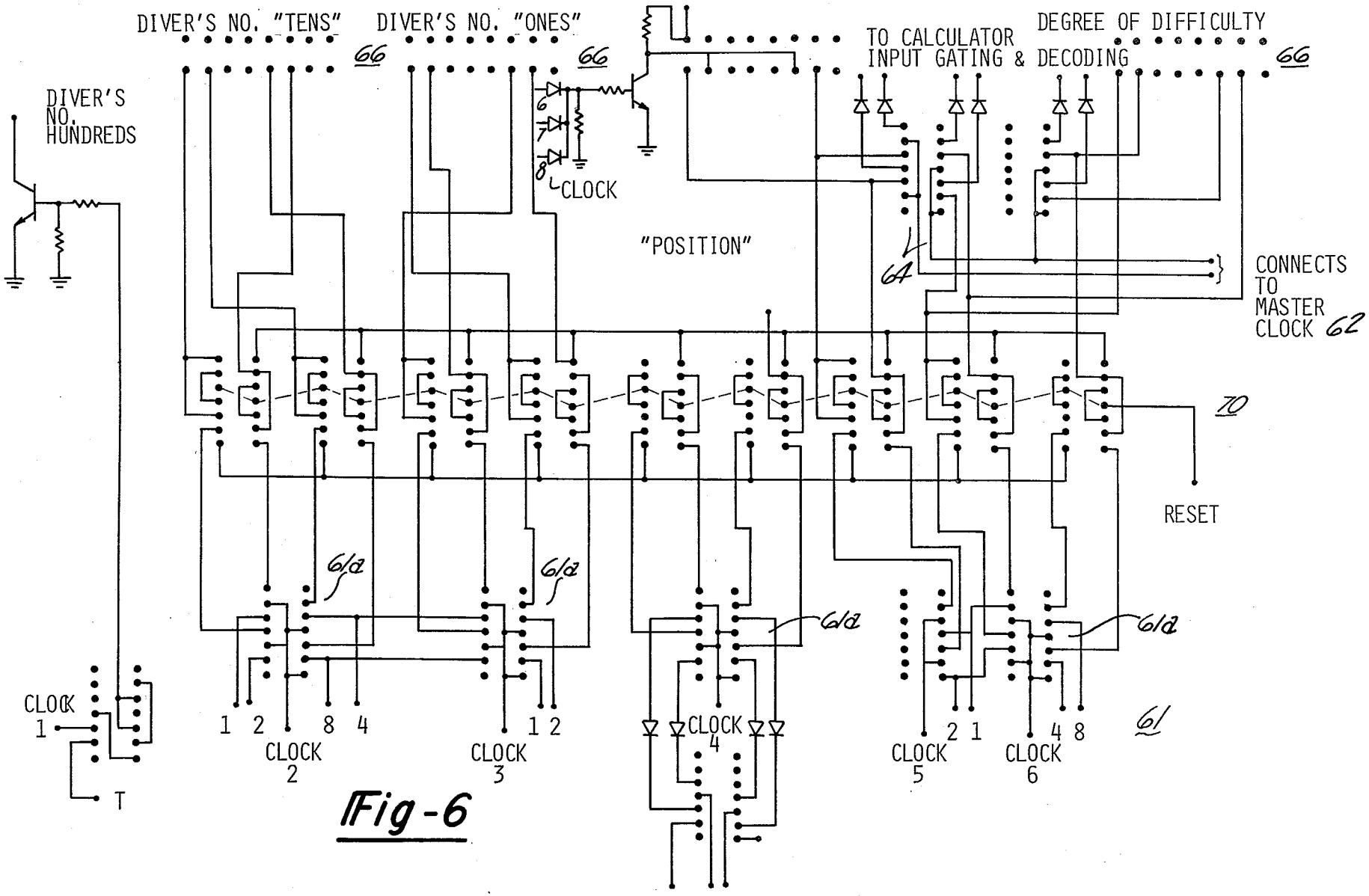

Reference is now made to FIG. 6 for clarifying the different types of data entered into the console keyboard 22. The decimal inputs from console keyboard 22 are converted into binary numbers by the decimal to BCD encoder 23. The binary inputs 1-2-4-8 are indicated at the lower row of input circuits 61. These are embodied as two input NAND gates 61*a* and have the function of setting the memories 70*a* in the row 70 above. Suitable clock input terminals are also shown in the lower row 60. The second set of gates in row 62*b* are connected as latches, i.e. cross-connected two input NAND gates. These represent the memories for the keyboard entry circuitry originating with console keyboard 22. In the next higher row in the schematic, there is included a pair of AND gates 64 which comprise the keyboard output gating stage 50 which represents the interface circuitry to calculator keyer stage 52. At the uppermost row of the FIG. 6 schematic, there are a plurality of display drivers 66 which operate to drive the seven-segment displays on the console which exhibit the number of the athlete and the degree of difficulty, as well as the position of the athlete. This represents a continuous data display. This completes the circuitry originating with the console keyboard 22.

Figure 7:
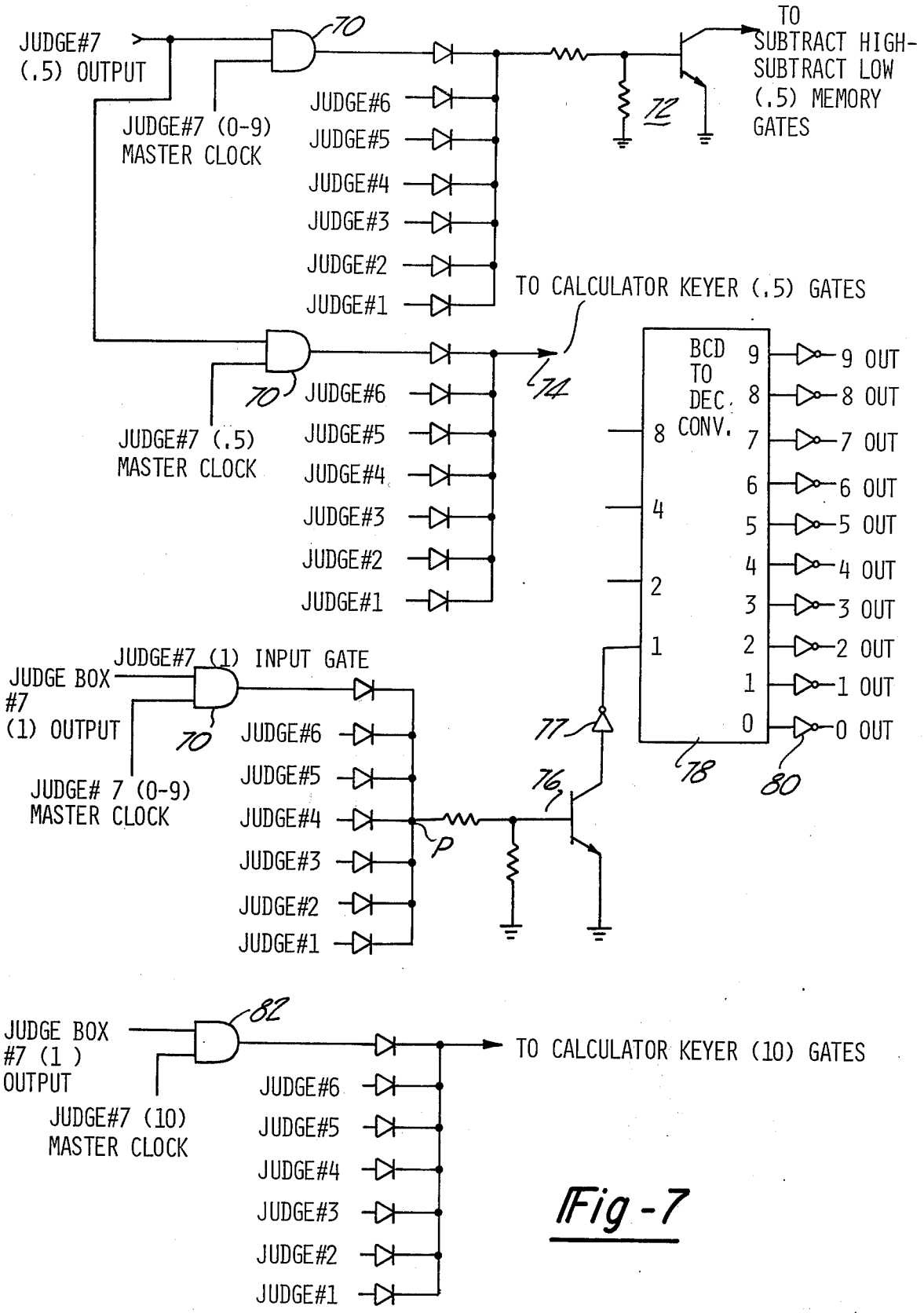
FIG. 7 is a schematic showing of a representative portion of the input gating and decoding stage of FIG. 2 illustrating the input from one of the judge's scoring stations.

Reference is now made to FIG. 7 and to the input gating and decoding stage 34 which receives its input from the judge score keyboard 20 as shown in FIGS. 1 and 2. Seven such keyboards 20 are included in the system. The input gating and decoding stage 34 receives an input from each judge keyboard corresponding to one or more of the decimal digits which are appropriately gated through AND gates 70 and through a driver stage 72 as an input to the next following high-low 0.5 gate of memory stage 36. A second output is provided from the next lower positioned terminal 74 to the calculator keyer (0.5) gate of stage 52. Next shown is the input from judge score keyboard 20 conforming to a (1) output which is gated with a pulse from the master clock 62 through a following transistor driver stage 76 as an inverted input through the operation of inverter 77 to the next following BCD to decimal converter stage 78, with final inverter stages 80 communicating to decimal outputs 0–9. The lowermost input representative of the (10) output from a judge score keyboard 20 is gated through a gate 82 and further to the (10) gate of the calculator keyer stage 52. The manner in which the inputs to the subtract-high, substract-low memory stage 36 are used will next be clarified in the description relating to FIGS. 3 and 4.

The basic purpose of the circuit of FIG. 3, which relates to the subtract-high function, is to determine from the data inputs of the seven judges which number in fact is the high number to be discarded. It is expedient during the computing sequence to be able with each new judge's score to look at the previous scores and determine whether the new judge's score is higher than the highest previous score entered. The basic operating elements of FIG. 3 are a four-bit comparator 80 and a quad latch 82. The quad latch 82 holds the highest previous score entered from any judge. The four-bit comparator 80 makes a comparison between that previous score and the latest entered score. The latest entered score will be indicated as "A" in the drawing. The previously memorized highest score is labeled "B" in the drawing. From the comparator 80 that looks at these two scores, we have two outputs. One output from the left hand terminal of the comparator is illustrated as B = A. The second output from the right hand terminal of the comparator 80 is indicated as B<A. This latter output indicates that the stored signal is lower than the new incoming signal. In the circuit, we will be using the equal relationship since the only part of the signal compared is the BCD portion of the judge's signal which represents the 0–9 number. It will be recalled from the input gating circuitry of FIG. 7 that we also have a separate bit identified as the (0.5) bit and a still further bit which is identified as the (1) in the 10 position of the number 10. It is necessary that these be handled as separate bits of data since these do not become included in the comparison process directly in the comparator 80.

On the lower part of the quad latch 82 we have binary data input lines D1–D4. These lines are normally in a low state and originate from the input gating decoding stage 34 as shown in FIG. 7. Everything is initially set at zero state by the "master clear" or gate 79 going to ground. The diodes 81*a–d* which are connected to the four inputs of the quad latch 82 also go to ground. The first number entered from a judge to make a comparison will be compared with the lowest possible signal, which is zero. Any number larger than zero which is seen from the first judge will get compared in comparator 80 to zero and, if it is greater than zero, the comparator 80 will have a high output at its B<A line. With respect to the output lines Q1–Q4 from the quad latch 82, these represent the initial condition of zero. This condition is set into the B0-B3 input lines on the comparator 80.

The first judge's incoming score now feeds into the top of the comparator 80. If that number is greater than zero, we will get a high output from the B<A output of the comparator 80 because the initial condition in the latch 82 was zero in the subtract-high circuit. When we have a high output indicating that we want to make a change, i.e. saying that it is desirable to change the data in the latch 82 and store the new data that came in higher than the old, we have to activate the clocking mechanism or the gating mechanism of the latch 82 which holds the data. This is accomplished by taking the B<A output and feeding it through an AND gate 84. The AND gate 84 will be clocked on only if we have a whole number condition being received from the judge. The master clock 62 has a specific bit for each judge which indicates that a whole number score is being entered from that judge. Thus, we must have both of two conditions satisfied. B must be less than A and we must be in a master clock 62 bit condition which allows us to compare the whole number. If it is comparing something other than a whole number at some other time, it will not get transferred into the memory. Assuming satisfaction of both conditions, we transfer that high condition through an OR gate 86 which activates the input gates within the quad latch 82. This allows the new data to be transferred into the D1-D4 lines on the quad latch 82 so that these are stored. Before the new input data is lost, the master clock 62 turns off and the B<A turns off so that erroneous data is not stored in the latch 82. We always have solid data coming in from the input lines. The clock 62 is shut off before the data entry lines are closed so that other data cannot be entered. This summarizes the process that results if the new score entered is higher than the preceding judge's score. That data thus becomes entered in the quad latch 82.

At the end of the above sequence after the scores of all of the judges have been looked at, that number which has been selected as the high judge score must be subtracted from the calculator 58 itself. At this point, the calculator has entered all of the judge's scores individually and arrived at a total of these scores. In order to subtract the high score, we look at the outputs Q1, Q2, Q3 and Q4 in the subtract-high quad latch 82. These are fed into a set of AND gates shown at the lower left hand portion of the FIG. 3 drawing and indicated by the numeral 90. These gates 90 are then clocked by the subtract-high (0–9) master clock bit and transferred into the calculator keyer stage 52. Otherwise stated, the subtract-high (0–9) master clock bit activates the gates 90 to enter the high number data into the calculator 58. This will be followed by a minus into the calculator from the master clock 62 so that it will at that point subtract this number. Accordingly, whatever number is presented as an output from the quad latch is Q1, Q2, Q3, Q4 in binary notation will now be transferred into the calculator 58 through the gates 90 and their isolation diodes 92 which connect to point P of FIG. 7 and to the other three corresponding points. The purpose of the diodes 92 is to isolate the TTL circuitry from the remainder of the circuit which uses a common decoder.

With respect to subtract-high circuitry of FIG. 3, the bits which correspond to the (10) and the (0.5) get entered directly into the interface of the calculator and do not go through the decoder. This process handles the subtract-high number which would represent a whole number between zero and nine.

The next condition which must be taken care of is the 0.5 condition which is a unique condition. Provision must be made for a number that contains a 0.5 because judge's scores can have one of 21 possibilities between 0 and 10. As an example, if we have a number one stored in the quad latch 82, the next judge's score is received with a value of 1.5. While the 1.5 is higher in value than the 1, the whole number portions are equal. The 1 is equal to 1 when the comparator 80 looks at and sees an equal situation, so that there is provided a high output from the comparator 80 and the B=A line. This goes into the NAND gate 94. Into the same NAND gate 94 we get an output from the input gating circuitry that tells us we have a 0.5 bit. The two-input NAND gate 94 has a normally high output state. When we have a 0.5 bit, we have a low output from the NAND gate. It is necessary to keep the 0.5 bit stored so that it later may be used in the subtraction process. It must be gated into the calculator. In order to store a bit that represents the 0.5 bit, the output of the NAND gate 94 grounds a set input in a memory 96. The memory 96 represents a 0.5 bit memory and it grounds it through a diode 99. The function of the diodes 98 and 99 is to isolate the NAND gate 94 from a second NAND gate 100, which is connected to the same point. Accordingly, in the situation where we have an equal, we also have a half which makes it a larger number. We thus set a bit into the 0.5 memory 96 and at the same time set the Q output of the 0.5 memory 96 high. The later sequence which occurs when this data is entered into the calculator 58 is as follows: the whole number will be entered from the 1, 2, 4, 8 function which comes off the quad latch 82. It will then enter a decimal and then the next clock pulse will be a subtract-high 0.5 pulse which will activate the two-input AND gate 103, with one input from the 0.5 memory 96 and the other from the master clock 62. In this manner, if there is a 0.5 bit memorized, it will transfer into the calculator 0.5 input lead and thus directly into the interface of the calculator input stage 52 as a 0.5.

We will next consider the situation where we have a number, such as a 1.5, and the next judge inserts as a score the whole number 2.0. In this case, the second judge's score is larger than the first so we have to accomplish two things. We have to eliminate the old whole 1 that was stored in the quad latch 82 and also eliminate the 0.5 bit. Otherwise, if the 0.5 bit were not eliminated, when entry is made into the calculator as a subtraction, the 0.5 would result in making the number 2.5. The following sequence is followed: with B<A, the stored 1 being less than the new 2 coming in, we go through the 84 gate in the same original sequence and replace the 1 stored in the quad latch 82 with a 2. It is then necessary to eliminate the .5 bit since that would make an invalid number. The 0.5 memory 96 has a reset line and, if we have a B<A condition, we have a true or a high input to the $\overline{0.5}$ input gate 102 which is connected to the reset function of the 0.5 memory 96. If we have no 0.5 coming into the other input to that NAND gate through the inverter which is further down the line, we have two true states. We have a 0.5 inverter to give us what says 0.5 on the first line to the gate so that reset of the 0.5 memory is made and the undesired 0.5 bit is removed from the subtract-high memory circuitry. Otherwise stated, when we have two true states on both inputs of the gate 102, we pull down the reset input of the 0.5 memory 96. This resets the memory so that the Q output on that memory goes low and there is no longer a bit stored in there. This leaves only the 2.0 which is desired to be stored in the whole number and the 0.5 bit has been eliminated.

Another condition which must be considered is the condition of the 10 which represents the largest number a judge can score. The 10 represents a zero in the zero through nine condition. It is thus necessary that data must be entered in the proper sequence into the calculator. That is the sequence that must be followed when subtracting or adding is to be done in the calculator stage 58. Thus, if you were to store 10 in the subtract-high system, it would be entered into the calculator as a 1, a zero, a decimal and a zero. So, if we have a 2 stored in the quad latch 82 and a 10 next follows, it is necessary to eliminate the 2 output from the quad latch 82 and substitute a zero, which is actually a lower number in the one's position. The substitution must be done so that the sequence entered into the calculator would not come out a 1, 2, 0.0. It is necessary to have a 1, 0, ., 0, so this must be provided. First it is necessary to store a bit which represents a 10. This is relatively easily done since any time you get a 10 input coming into your input gating circuitry as shown in FIG. 7, this is provided as an input to the 10 memory 104 shown in the upper right hand corner of FIG. 3. When the 10 memory 104 is set, it stores a single bit representing a 10 and the 10 output gate 106 receives the Q output and at the appropriate time the AND gate 106 is clocked by the subtract-high 10 master clock pulse. There is then provided a high output from the gate 106 which is transferred into the 1 input on the calculator stage in the same manner as if a person had manually entered the 1 in the 10 position of the 10. It is necessary to keep the quad latch 82 data (previously stored number 2) from being entered into the calculator during the subtract-high (0–9) master clock bit period. This is done by clamping the master clock bit to ground through diode 302 whose cathode is connected to the (10) memory $\overline{Q}$ output which has been set low. This will not allow the AND gate 90 to transfer the data from the quad latch 82 and will represent a zero.

It will be understood that the highest possible score is 10 in many events, for example in diving, so it is not possible to get a score of 10.5. It is necessary to eliminate the one-half which may already be stored in the 0.5 memory 96. It is thus necessary to reset the memory 96. The reset line has two lines going to it, including a second line which comes from the $\overline{Q}$ of the 10 memory 104. Thus, if a 10 is stored in the 10 memory, its $\overline{Q}$ goes high and its $\overline{Q}$ goes low. In its low output condition, the $\overline{Q}$ will reset the memory 96 through the diode 110. In this manner the output from the 0.5 memory 96 Q terminal goes to zero whenever a 10 has been entered into the subtract-high circuitry. This handles the situation where there might have been a previous 0.5 and the 10 must be the highest number capable of being entered. The final result is in the gating sequence, when the calculator has initiated the subtraction of a high number it will look at the 10 output gate 106. If it is high, a 1 will be fed into the calculator. Next, the 1-2-4-8 output gates from the quad latch 82 will be looked at and these will enter a zero into the calculator. The calculator automatically gets a decimal added into it and then looks at the 0.5 gate. If a 10 was present, the 0.5 gate would be zero also, so that a 10 decimal or a 10 would be entered into the calculator.

In the master clear function which is initiated by stage 44, the gates are grounded. The reset of the 10 memory 104 is grounded through a diode 112 which sets the Q output of the 10 memory 104 to zero, places it into the zero initial condition. The same result is provided for the 0.5 memory 106 and for the quad latch 82.

The FIG. 4 drawing shows the subtract-low memory gating stage which is a part of the combined high-low memory stage and high-low subtract gating stage 36, 34 as shown in FIG. 2. There are some similarities between the circuits of FIGS. 3 and 4. The basic elements of both are a four-bit comparator 180 and a quad latch 182. The whole number portion of the low number is stored in the quad latch 182. However, the four-bit comparator 180 in the subtract-low circuitry has two outputs: B = A and B>A. Also included in the FIG. 4 circuit at its left side is a gate 194 which is used to take the output of the 10 memory to the calculator keyboard circuit — the tens digit of the 10. The gating circuit 190 takes the 1-2-4-8 representing the whole number from the quad latch 182 and these are fed into a set of AND gates shown at the lower left hand portion of the FIG. 3 drawing and indicated by the numeral 90. These gates 90 are then clocked by the subtract-low ( 0–9) master clock bit and transferred into the calculator keyer stage 52. Otherwise stated, the subtract-low (0–9) master clock bit activates the gates 90 to enter the high number into the calculator 58. There is also a 0.5 memory 196 and a gate 203 which transfers the 0.5 information to the calculator in the same manner as was done in the subtract-high circuit. The temporary 10 memory 204 is also included. One basic difference from the subtract-high operation is that the initial state of the latch 182 must be the highest number possible because then any judge whose score we look at the first will have his information entered in there. With the subtract-high operation, everything is set low as previously explained. In the subtract-low circuit of FIG. 4, the initial state has everything set high.

OR gates 171 perform a dual function of transferring judge input data and of transferring the initial high state when master clear is depressed. When master clear is depressed, inverter 173 output goes high. This allows the initial clear of OR gates 171 which were previously clamped low through diode 175 to go high. At the same time, the output of OR gate 186 goes high and allows the clock input of quad latch 182 to go high and to store the initial high from OR gates 171. The data entry is "B", the initial number which is in fact greater than the first judge whose score will be looked at and the score from the first judge is entered as the true information.

The following is a description of the subtract-low mode of operation with reference to FIG. 4. Assuming the first judge's score was a number 9, this would represent the input from the judge score keyboard 20 and "A" in FIG. 4. "A" is compared to the arbitrary number 15. Since 9 is less than 15, or otherwise stated, 15 is greater than 9, we take from the B>A output a signal transferred through a gate 184. This is transferred to an OR gate 186. The latch 182 is opened and the new number, the number 9, is entered into the quad latch 182. To provide this operation, a bit comes from the master clock to gate 184 and this bit terminates before the data terminates so that we are sure of transferring good data into the quad latch 182. At this point, we have scored the new number 9 from the first judge. Now we have a basis for comparison with real data. We have seven judges, have entered the first judge's score and each judge' s score thereafter will be compared with it until one of these judges has a lower score. At that point, that lower score will be entered in following the same sequence of operation just described.

Consideration will now be given to the situation where we have a one-half involved and desire to store a 9.5. It is necessary to set the 0.5 memory to store the 9.5, since 9.5 is a lower score than the initial arbitrary 15 that we stored in the memory. We get a B>A output, and the whole number part of the 9.5 stored in the quad latch 182 as a binary number. We also have another output from the subtract-high 0.5 memory gate inverter 177. This presents a high state to the NAND gate 200 and a signal representative of a 0.5 going to the other side, which makes the output of the NAND gate 200 low and sets the 0.5 memory 196 with a bit that represents a 0.5 bit, sets Q high and now we have a 9.5. Thus, we have a number 9 stored in the binary section of the quad latch 182 and a 0.5 stored in the 0.5 memory 196.

We will next consider the situation where we have the judge entering a score of 9 after a 9.5 has been stored. It is necessary to eliminate the 0.5 bit. We eliminate it in a similar manner to the way in which we handled it with the subtract-high circuit of FIG. 3. We make a comparison of the whole numbers and the whole numbers in this case would come out equal, with both the stored number and the new number being 9. We then receive an output from the B = A line from the comparator 180, pass it through the gate 181 to eliminate erroneous data. There is next provided a two-input NAND gate 183 at the left side of the drawing. In the event we have a B = A output signal and do not have a 0.5, there will be a 0.5 inverted signal through inverter 185 entering the gate 183. The two-input NAND gate 183 goes low. Since it is connected to the reset of the 0.5 memory 196, it resets the memory 196 to have no output. Thus, it will be seen that if we have the condition where a score including a whole number and a half is followed by the next score of a whole number without a half and the same whole number, the half will be subtracted from the memory and we will retain only the whole number, which is the true lowest score to that point.

We will next consider the situation of the 10 entry score. A problem exists with respect to the number 10 because in the one's position of the 10 there is a zero. This gives rise to the necessity for a temporary 10 memory 204 which is necessary to prevent a false entry of data into the quad latch 182. The judge's score is looked at in the following sequence as programmed by the master clock; (a) is there a zero or a 1 in the 10's position, (b) is there a zero through 9 in the one's position? If there is in fact a digit in the 10 position of the judge's score, the temporary 10 memory 204 will be set. At that point, with the temporary 10 memory set, the $\overline{Q}$ output goes low. When the $\overline{Q}$ goes low, it pulls down the common anode connection of both diodes 205 and 207 to zero or close to ground. The one-bit from the 10 was entered before the binary comparison was made under the master clock control. With the one-bit entered, comparison will be made of the whole number in the one's part of the judge's score. The output will go high on the B>A line. However, because the input to the next following gate 184 has been clamped to ground by the temporary 10 memory 204, it cannot enable the latch 182 to accept the information. Otherwise stated, the information cannot be transferred to the latch 182. Even though a zero may come in as an "A", it will not get transferred into the latch because we have clamped the latch 182 input to ground by the $\overline{Q}$ input from the temporary 10 memory 204. It is, of course, necessary to reset the memory 204 so that the next time it will handle the situation where a judge may not have a 10, but in fact may have a true zero. Resetting is provided by a reset pulse from the master clock 62. The reset pulse is actually the 0.5 master clock pulse. Thus, after the whole number is entered, we look and see if there is a 0.5. This is a valid pulse which comes on each judge scoring cycle so that we can use it and by passing it through an inverter, we can ground the reset input into the temporary memory 204 and eliminate the storage of that memory. $\overline{Q}$ thus stays high until another 10 comes along. Accordingly, if one of the following judges scores another 10, and the original one was still scored, we will want to retain that one that is lower than 10. 10 will set the temporary 10 memory 204 again, clamp off the input and upon receipt of the 0.5 master clock pulse for that particular judge will reset temporary 10 memory 204 to zero again and make preparation for a comparison with the next judge's score.

During the substract-low and subtract-high periods, it is necessary that the quad latch 182 not accept data. This is accomplished by setting temporary memory 204 at the beginning of such periods by master clock pulses subtract-high 10 and subtract-low 10 through inverter 300.

Consideration will next be given to the situation where all the judges have scored a 10. This is a possible situation and the question arises as to how the low score can be stricken, for example when seven judges have given the 10. The circuit handles the situation by first of all setting the temporary 10 memory 204. The quad latch 182 retains the score of 15 throughout the judge interrogation period so that cannot be used as an entry into the calculator part of the number 10. There is a diode OR gate comprising diodes 191 with the common anodes all high as an input to the 10 output gate 194 at the left side of the drawing. It is thus possible to enter the number 1 as part of the number 10 into the calculator. This is because when the master clock 62 provides an input to the other gate 194 input there is a true state on the original input that connects the diode OR gate. This would, in fact, give you a high output from that gate and transfer that as a 1 to a calculator so that the 1 in the 10 position was satisfied. For the subtraction of one of the judge's, 105, you have to subtract these two numbers and end up with only five judge's scores. It is now necessary to satisfy the condition of the 0 in the 0 through 9 position of the judge's score. Also tied to the diode OR gate 191 is an inverter 193 which is called the subtract-low inverter. When the inverter 193 has a high input, of course, its output is low. The low output clamps through a diode 195 and thus clamps all of the gates 190 low for the 0–9 whole numbers. Thus, when the master clock 62 operates to enter the 15 that would be stored in the latch 182, the clock signal is negated by the inverted clamp signal so the 1-2-4-8 gates 190 are never activated by the master clock, since its signal is eliminated. The calculator sees the output as nothing and the zero is automatically entered by the calculator.

Figure 5:
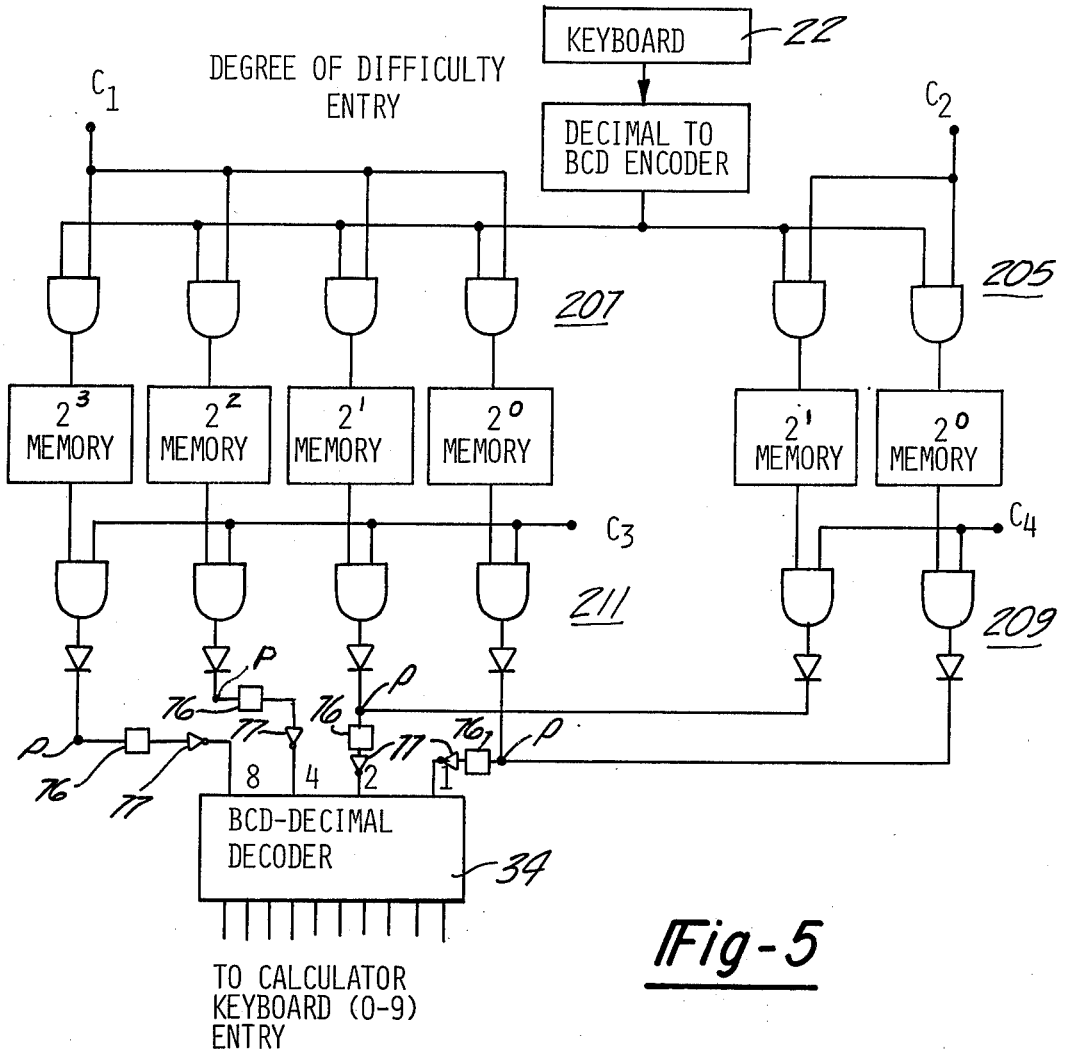
FIGS. 5 and 6 are combined schematic and block diagrammatic showings of the console keyboard and associated circuitry for entering the degree of difficulty and other information for display purposes.

In the lower right hand corner of FIG. 5, there is shown a large OR gate made up of a plurality of seven diodes 197. The upper seven diodes 197 are provided from the judges' inputs and each represent a 0.5 input which would cause the temporary memory 204 to be reset through the discrete inverter stage 199.

Reference is now made to the drawing of FIG. 5 which illustrates the circuitry for entering by keyboard 22 the degree of difficulty information which will subsequently be used in the calculator stages 52–58. The keyboard 22 is operated by the console operator entering a decimal number from 0–9. This decimal input is converted to binary coded decimal in a decimal to BCD encoder 23. A plurality of gates 205, 207 are included in the inputs. The gates are normally clocked by a shift register that shifts when the keyboard buttons are depressed. The clocking of C2 enables two AND gates 205, one for two to the zero power and one for two to the first power, which allows the counting to the maximum number of three in binary notation. Thus, when the keyboard 22 has a key depressed and clocks C2, the number which has been provided through an appropriate D to BCD encoder 23 gets transferred into the first character memory which has a capacity of any number from zero to three. When the keyboard 22 is released and then depressed for the second number, the shift register will shift over to clock C1 and a second set of gates 207 which are capable of handling a binary coded decimal number of zero through nine. The signal which is transferred from the BCD encoder goes into this set of memories in stage 48. The master clock 62 enables the gates 209 and 211 which are included in stage 50 of FIG. 2. The two characters of the degree of difficulty number are therefore entered into the calculator for operation when the master clock 62 enables the appropriate gates 209 and 211. Master clock pulses C3 and C4 are provided at like identified input terminals of these gates.

Figure 8:
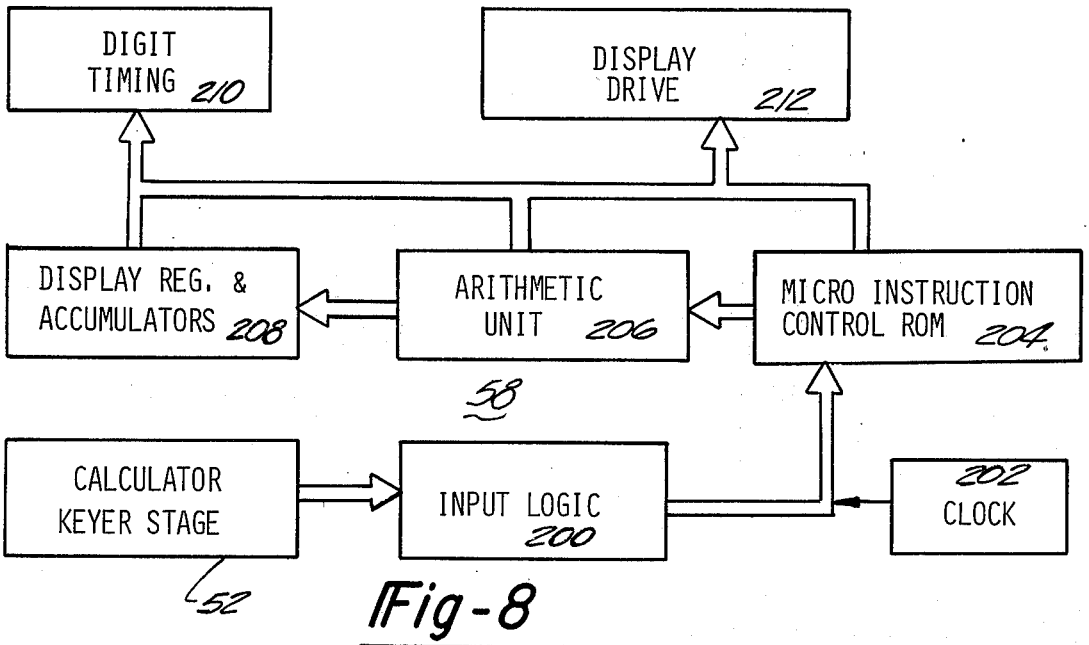
FIG. 8 is a block diagrammatic showing of a single chip calculator usable in the system.

FIG. 8 shows in block diagrammatic form the main parts of the calculator stage 58. These include the input received from the calculator keyer stage 52 at the left side of the input logic stage 200. A clock pulse source 202 is included to provide timing control of the calculator. A micro-instruction control ROM 204 provides a control of the operation of the next following arithmetic unit 206, whose output is provided to the display register and accumulator stage 208. A digit timing control stage 210 and display drive stage 212 are used to finally connect the output of the calculator to the main console display 40 and, if desired, to the display board 32 as previously shown in the FIG. 1 drawing.

It will thus be seen that by my invention I have provided a novel and improved system for scoring athletic events involving both the necessary arithmetic computations and the display of necessary identification data along with the finalized scores arrived at.

I claim as my invention:

1. A system for computing scores for athletic events, comprising:

multiple data input means for providing a data input representative of each one of a plurality of judges' scores;

second data input means for providing an input representative of weighting factor and degree of difficulty;

means for eliminating the data related to the highest and the lowest of said judges' score;

calculator means for multiplying the combined judges' scores, less the highest and lowest score, by the weighting factor; and means for displaying the final computed score.

2. The combination as set forth in claim 1 wherein the display means comprises an enlarged display scoreboard mounted for viewing by all spectators of the event.

3. The combination as set forth in claim 1 wherein there is provided a printer means operated from the calculator means for providing a print-out record of the judges' and final scores in each different cycle of scoring.

4. The combination as set forth in claim 1 wherein said eliminating means comprises in each case a comparator and latch stage.

5. A system for scoring athletic events, comprising;

a plurality of judge score input keyboards, each such keyboard operated by a different judge;

a second keyboard associated with a console for providing data inputs respectively representative of position, athletic identification number and degree of difficulty;

means for eliminating the high one of said judges' scores;

means for eliminating the low one of said judges' scores;

means for combining the remainder into a total score;

calculator means for multiplying said total score by the degree of difficulty factor to arrive at a final computed score; and means associated with said console for displaying the final computed score.

6. The combination as set forth in claim 5 wherein said keyboards for providing judge score inputs are operably connected to an input gating stage, said input gating stage connected intermediate all of said judge score keyboards and said means for eliminating the high and low scores from the judge score inputs.

7. The combination as set forth in claim 5 wherein said means for eliminating the high score comprise in each case a comparator and latch stage, and wherein each successive judge's score is compared to the one preceding it and the higher of the two is stored for the next following comparison.

8. The combination as set forth in claim 5 wherein said means for eliminating the low score in each case comprises a comparator and latch stage, and wherein each successive judge's score is compared to the one preceding it and the lower of the two is stored for the next following comparison.

9. A system for scoring athletic events, comprising: a plurality of judge score input means, each operated by a different judge;

a keyboard associated with a console for providing a data input representative of a selectively preassigned degree of difficulty of the event being scored;

means for eliminating the high one of said judges' scores;

means for eliminating the low one of said judges' scores;

means for combining the remaining judges' scores into a total score;

calculator means for multiplying said total score by said degree of difficulty factor and arriving at a final score; and means for displaying the final score for the spectators of the event.

10. The combination as set forth in claim 9 wherein said means for eliminating the high and low scores comprise in each case a different combination of comparator and latch stage, and wherein each successive judge's score is compared to the one preceding it and the higher and lower, respectively, of the two are retained for the next following comparison.

11. The combination as set forth in claim 9 wherein said judge score input means are operably connected to an input gating stage, said input gating stage connected intermediate all of said judge score input means and said means for eliminating the high and low scores from the judge score inputs.

12. The combination as set forth in claim 9 wherein said means for eliminating the highest score comprises in each case a comparator and latch stage, and wherein each successive judge's score is compared to the one preceding it and the higher of the two is then stored for the next following comparison.

13. The combination as set forth in claim 9 wherein said means for eliminating the low score in each case comprises a comparator and latch stage, and wherein each successive judge's score is compared to the one preceding it and the lower of the two is stored for the next following comparison.

14. The combination as set forth in claim 9 wherein said eliminating means comprises in each case a separate comparator and latch stage.

15. A system for scoring athletic events, comprising:

a plurality of judge score input means, each operated by a different judge;

a console for receiving a total score input and representative of the final score and displaying it;

means for eliminating the high one of said judges' scores;

means for eliminating the low one of said judges' scores; and means for combining the remaining judges' scores into a total score and for transmitting it into said console for providing a visual indication of said total score.

16. The combination as set forth in claim 15 wherein said means for eliminating the high one of said scores comprises in each case a comparator and latch stage, and wherein each successive judge's score is compared to the one preceding it and the higher of the two is stored for each next following comparison.

17. The combination as set forth in claim 15 wherein said means for eliminating the low score in each case comprises a comparator and latch stage, and wherein each successive judge's score is compared to the one preceding it and the lower of the two is stored for each next following comparison.

18. The combination as set forth in claim 15 wherein said means for eliminating comprises in each case a comparator and latch stage having its output operably connected to said console.

19. The combination as set forth in claim 15 wherein said judge score input means each comprises a different keyboard, all such keyboards operably connected to an input gating stage, said input gating stage connected intermediate all of said keyboards and said means for eliminating the high and low scores from the judge score inputs.

20. The combination as set forth in claim 15 wherein there is further included a printer means operated by said calculator means for providing a print-out record of the individual judge's and final scores for each event.

* * * * *